United States Patent [19]

Blue et al.

[11] 3,996,640

[45] Dec. 14, 1976

[54] FILTERING MECHANISM

[76] Inventors: Maurice R. Blue, 60960 Crown Court, South Bend, Ind. 46614; Landon Hudson, 608 Aldridge Drive; Ralph G. McCauley, 3113 Mayfair Drive, both of Kokomo, Ind. 46901

[22] Filed: Oct. 15, 1974

[21] Appl. No.: 514,362

[52] U.S. Cl. ..... 15/320; 15/353; 210/380 R

[51] Int. Cl.[2] ..... A47L 11/30

[58] Field of Search ..... 15/320, 321, 353; 210/330, 360 R, 360 A, 380, 369

[56] References Cited

UNITED STATES PATENTS

| | | | |
|---|---|---|---|
| 1,160,052 | 11/1915 | Dibbets | 210/380 X |
| 1,647,005 | 10/1927 | Keefer | 15/320 |
| 1,801,135 | 4/1931 | Blogg | 15/320 |
| 3,075,693 | 1/1963 | Dega | 210/360 A |
| 3,356,218 | 12/1967 | Grudoski | 210/380 X |

*Primary Examiner*—Christopher K. Moore

*Attorney, Agent, or Firm*—Woodhams, Blanchard and Flynn

[57] ABSTRACT

A filter system particularly suitable for use with a mobile floor cleaning machine. The filter system includes a first tank for receiving therein a contaminated liquid, specifically a floor cleaning liquid containing floor wax and dirt particles, and a second tank for collecting the filtered floor cleaning liquid to permit reuse thereof. The two tanks are joined by a centrifugal filter device having a rotatable filter unit which causes the contaminated liquid to flow radially outwardly through filter means which effectively removes from the liquid all solid particles except for particles of extremely small size, such as less than approximately one micron. The filter system, when mounted on a floor cleaning machine, has the first tank connected with a suction device which picks up the contaminated liquid from the floor, whereas the second tank supplies the filtered liquid to the brushes.

7 Claims, 8 Drawing Figures

FILTERING MECHANISM

FIELD OF THE INVENTION

This invention relates to a filtering system and, in particular, to a filtering system for permitting the removal of dirt and other contaminating particles from a floor cleaning liquid to permit reuse thereof. The filtering system of the present invention is particularly suitable for incorporation into a floor cleaning machine.

BACKGROUND OF THE INVENTION

The hard surfaced floors in many public and commercial buildings, such as hospitals and schools, are cleaned by means of manually controlled cleaning machines which are provided with rotating brushes for scrubbing the floors and a wiper-type vacuum system for removing the dirty liquid from the floor. Machines of this type, which are of conventional construction, are normally provided with a first storage tank thereon containing the cleaning liquid which is supplied to the brushes, and are also provided with a second storage tank thereon for receiving the dirty liquid removed from the floor. While machines of this type operate in a satisfactory manner, nevertheless the cost of cleaning floors in this manner is expensive since the cleaning fluid is used only once. This results in the machine utilizing excessive quantities of cleaning fluid, which is itself expensive, and also requires that the machine be periodically stopped to permit the first tank to be filled with cleaning fluid and the second tank to be emptied of dirty liquid.

Accordingly, it is an object of the present invention to provide an improved filter system for treating cleaning liquid containing dirt and other contaminating particles therein, which filtering system is capable of removing the dirt and contaminating particles from the cleaning liquid so as to permit the cleaning liquid to be reused several times.

A further object of the present invention is to provide an improved filter system, as aforesaid, which utilizes a rotating centrifugal filter which is effective in removing the contaminating materials from the cleaning liquid, with the filter unit incorporating therein filter pads which can be easily and efficiently interchanged when necessary.

Still a further object of the present invention is to provide an improved filter system, as aforesaid, which is particularly suitable for mounting directly on a floor washing machine to permit the continual cleaning and recycling of the cleaning liquid through the machine during operation thereof.

It is also an object of the present invention to provide an improved filter system, as aforesaid, which is extremely simple in operation, which is relatively inexpensive to manufacture and maintain, and which is effective in removing a large majority of the contaminating particles from the cleaning liquid so that the cleaning liquid can be reused several times prior to disposal thereof, thereby substantially minimizing both the amount and the total cost of the cleaning liquid required.

Other objects and purposes of the present invention will be apparent to persons acquainted with systems of this type upon reading the following specification and inspecting the accompanying drawings.

Figure 1:
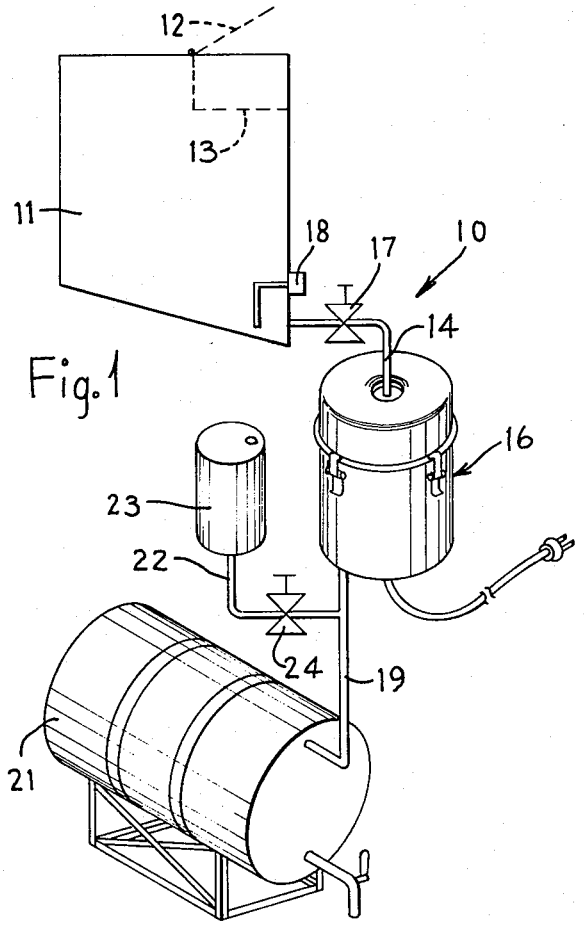
FIG. 1 is a perspective view of an improved filter system according to the present invention.

Certain terminology will be used in the following description for convenience in reference only and will not be limiting. For example, the words "upwardly," "downwardly," "leftwardly" and "rightwardly" will refer to directions in the drawings to which reference is made. The word "forwardly" will refer to the normal flow direction of the liquid throughout the filtering system. The words "inwardly" and "outwardly" will refer to directions toward and away from, respectively, the geometric center of the apparatus or system, and designated parts thereof. Said terminology will include the words above specifically mentioned, derivatives thereof and words of similar import.

SUMMARY OF THE INVENTION

According to the present invention, there is provided a filtering system which includes a supply tank containing a liquid to be filtered, namely cleaning liquid containing dirt and other contaminating particles, and a collection tank for receiving therein the filtered cleaning liquid. The contaminated liquid is supplied from the storage tank to a centrifugal filter device which is effective in removing the dirt and other solid contaminating particles from the liquid, with the filtered cleaning fluid then being discharged into a collection tank. The centrifugal filter device includes a rotatable drumlike filter unit which rotates substantially about a vertical axis and has the contaminated liquid deposited in the interior thereof. The cylindrical sidewall of the filter unit has a filter pad associated therewith which removes dirt and other solid particles from the liquid as the liquid is forced radially through the pad due to centrifugal force. The filtered liquid collects in a casing which surrounds the rotating filter unit and flows by gravity into the collection tank. The filter unit, in a preferred embodiment of the invention, has a plurality of angularly spaced, circular openings formed through the sidewall of the drumlike casing, with each opening being covered by a thin filter material supported by meshlike screens. The screens and filter are held in place by a removable cap.

In a preferred embodiment of the invention, the above-described filter system is mounted on a mobile cleaning machine so that the collecting tank supplies the filtered cleaning liquid directly to the rotating brushes. The contaminated liquid which is removed from the floor is then resupplied to the storage tank so that the cleaning liquid can be filtered for reuse, thereby permitting the cleaning liquid to be recycled several times through the machine prior to disposal thereof.

DETAILED DESCRIPTION

FIG. 1 illustrates an improved filter system 10 according to the present invention, which system is particularly suitable for removing dirt and other solid contaminating particles from a liquid, specifically a floor cleaning liquid. The system 10 includes a storage or holding tank 11 for the dirty or contaminated liquid, which tank has a swingable cover 12 for permitting the liquid to be deposited therein. A screen 13 is associated with the opening of the tank to permit removal of large contaminating particles or objects. The contaminated liquid is supplied from tank 11 through conduit 14 to a centrifugal filter device 16, with flow through conduit 14 being controlled by a control valve 17. Valve 17, in the illustrated embodiment, comprises an electrically operated solenoid-type valve which is normally maintained in a closed position. Tank 11 also has a liquid level shutoff device 18 associated therewith, which shutoff device may comprise a flowtype valve which will close when the liquid level within tank 11 drops below a predetermined minimum so as to deactivate the complete system.

The contaminated liquid as supplied to the filter device 16 is filtered internally of the device, and the filtered liquid is then discharged through a conduit 19 into a collection or holding tank 21. The discharge conduit 19 also communicates with a further conduit 22 which is connected to a makeup tank 23. The tank 23 contains therein a quantity of new floor cleaning liquid. Conduit 22 also has a control valve 24 associated therewith, which valve may also comprise an electrically controlled solenoid-type valve which is normally maintained in a closed position.

Figure 2:
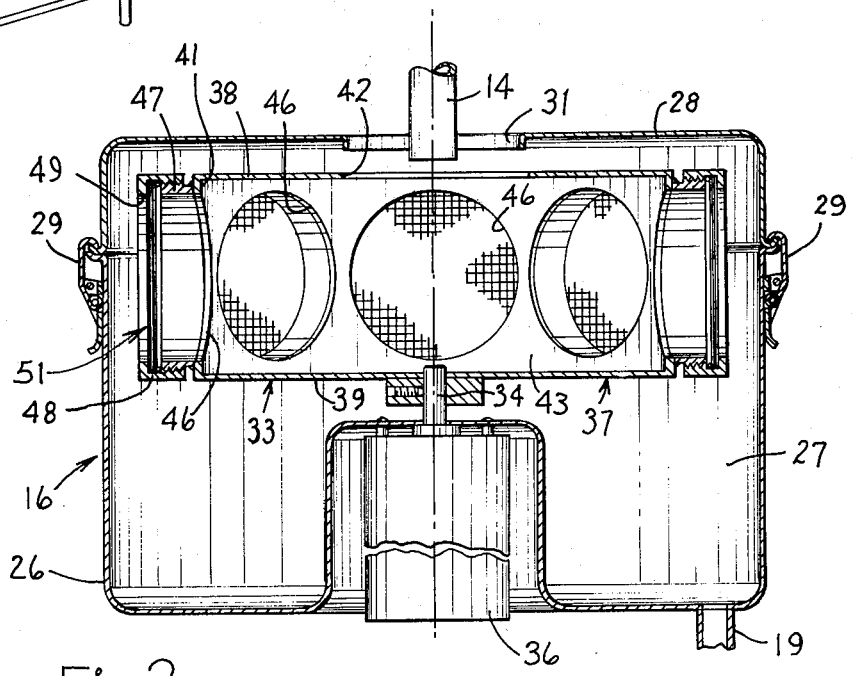
FIG. 2 is an enlarged view, taken partially in cross section, of an improved centrifugal filter device associated with the system of FIG. 1.

The centrifugal filter device 16, as illustrated in FIG. 2, includes a substantially cylindrical casing 26 defining therein an interior compartment 27 which communicates with the discharge conduit 19. Casing 26 has a removable cover 28 on the upper end thereof, which cover is connected to the casing by a plurality of conventional releasable clips 29. The cover 28 has an inlet opening 31 formed in the center thereof, which opening receives therein the lower end of the conduit 14.

A rotatable filter unit 33 is disposed within the casing 26 and is nonrotatably secured to the upper free end of a rotatable motor shaft 34, which shaft 34 is driven by a conventional drive motor 36. The drive motor 36 preferably comprises a conventional electric motor and is disposed so that the filter unit 33 is positioned for rotation about a substantially vertical axis which is aligned with the longitudinal axis of the cylindrical casing 26.

Figure 5:
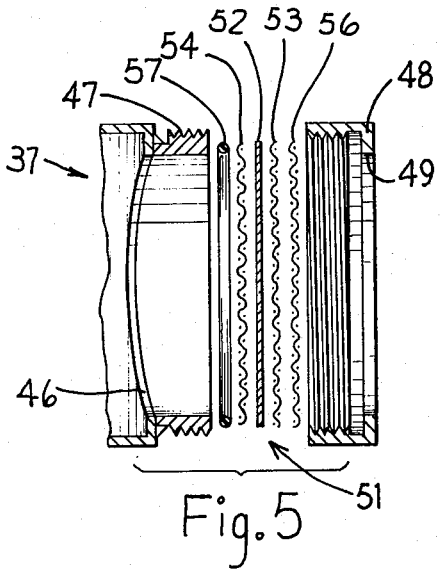
FIG. 5 is an exploded cross-sectional view taken substantially along the line V—V in FIG. 4.
Figure 3:
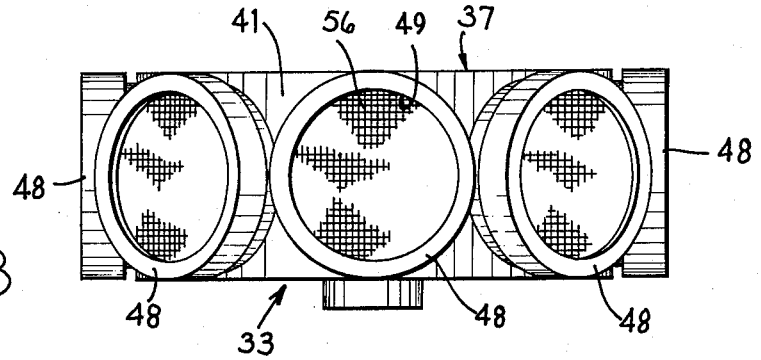
FIG. 3 is a side elevational view of the filter unit.
Figure 4:
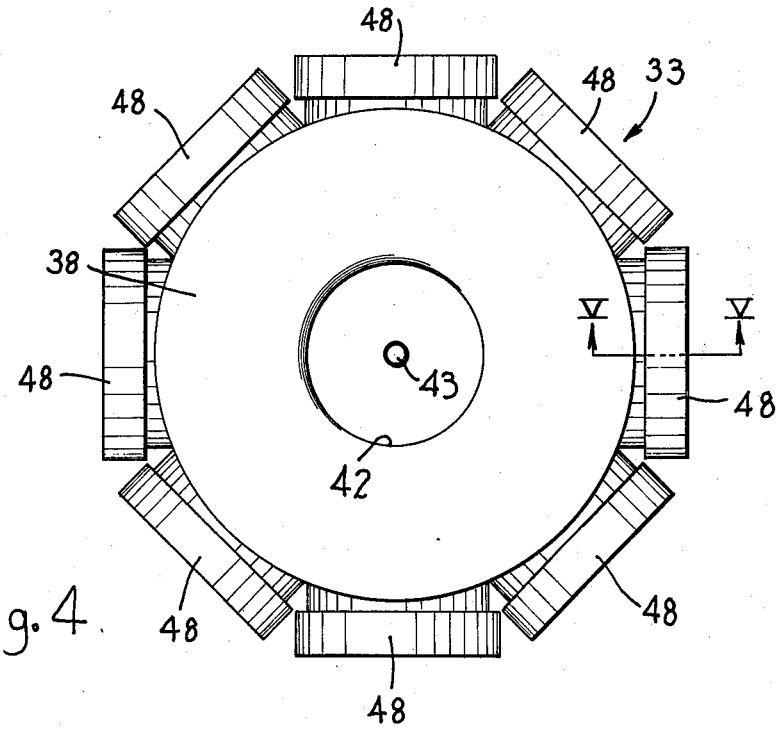
FIG. 4 is a top view of the filter unit illustrated in FIG. 3.

As illustrated in FIGS. 2–4, the filter unit 33 includes a drum-like cylindrical casing 37 having substantially parallel top and bottom walls 38 and 39, respectively, connected by an annular sidewall 41. An inlet opening 42 is located centrally of the topwall 38 and disposed closely adjacent and substantially aligned with the opening 31 so that the contaminated liquid can be discharged from the conduit 14 through the opening 42 into an interior compartment 43 defined within the filter unit 33. The sidewall 41 of the casing 37 has a plurality of discharge openings 46 formed therein, which openings 46 in the illustrated embodiment are circular and are angularly spaced around the peripheral sidewall 41. A sleevelike hub 47 is fixedly secured to the annular sidewall 41 and projects outwardly therefrom so as to function as an extension of each discharge opening 46 as illustrated in FIGS. 2 and 5. Each sleevelike hub 47 has a removable cap 48 threadably engaged on the outer end thereof, which cap also has an opening 49 formed therethrough and aligned with the respective discharge opening 46.

A filter pack 51 (see FIGS. 2 and 5) is clampingly supported between each hub 47 and its respective cap 48 for filtering the liquid which is centrifugally discharged through each of the openings 46. The filter pack 51, in the illustrated embodiment, includes a disklike filter pad 52 (to be described in detail hereinafter) supported between a pair of disklike mesh members 53 and 54. The mesh members 53 and 54 comprise wire mesh screens, preferably of stainless steel, with the screens being of extremely fine mesh, such as No. 40 mesh screen. The screens 53 and 54 function to support the filter pad 52, which pad is of an extremely thin and flexible material and thus requires the support of the screens 53 and 54 to prevent damage to the filter pad when liquid is flowing therethrough. A further disklike support member 56 is disposed adjacent the exterior surface of the screen 53, which support member 56 also comprises a wire mesh screen of relatively coarse mesh. Screen 56 is also preferably of stainless steel, and in an exemplary embodiment is a No. 5 mesh screen. The filter pack 51 is completed by means of an O-ring gasket 57 which is positioned adjacent the interior side of the screen 54. The filter pack 51, assembled in the order illustrated in FIG. 5, is clampingly held between the hub 47 and the cap 48, with the compressible and preferably resilient gasket 57 permitting a secure clamping force to be maintained around the complete periphery of the stacked disklike members 52, 53, 54 and 56.

Considering now the filter pad 52, same comprises a thin, flexible, sheetlike material which permits the free passage of liquid therethrough but effectively filters out all solid particles having a size in excess of a selected magnitude. In a preferred embodiment, the filter passage 51 will effectively prevent passage therethrough of all solid particles having a size greater than 1 micron. The filter pad is preferably constructed from a Milapore filter material having a thickness of approximately 10 mils, which filter material is manufactured by Milipore Corporation of Bedford, Mass.

OPERATION

The operation of the filter system 10 will be briefly described to ensure a complete understanding thereof.

Figure 6:
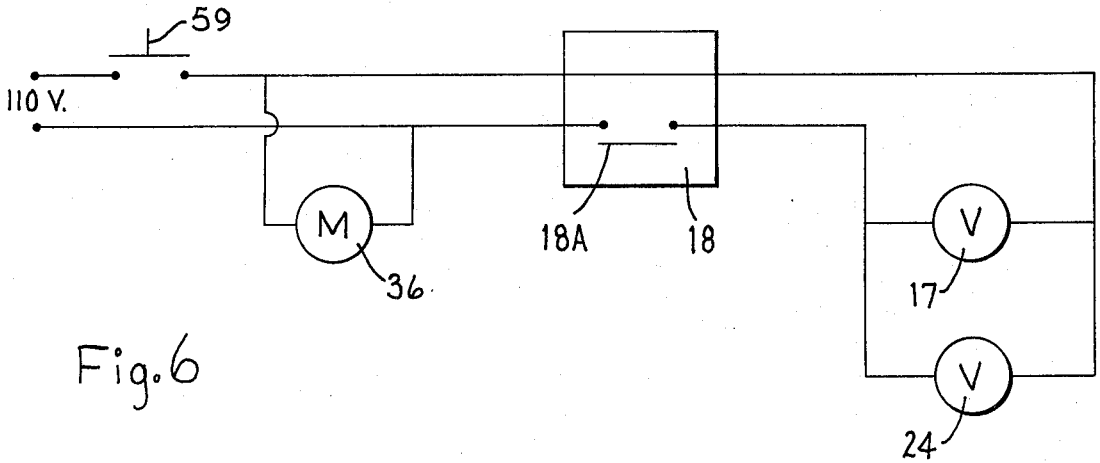
FIG. 6 is a diagram illustrating the electrical control circuit for the system of FIG. 1.

When operation of the system 10 is desired, the contaminated cleaning liquid containing floor wax and dirt particles therein will be deposited into the tank 11. The screen 13 will effectively remove only the larger dirt particles. When sufficient contaminated liquid has been deposited in the tank 11, this will cause actuation of the float-type liquid level shutoff device 18, thereby causing the contacts 18A (FIG. 6) associated therewith to be closed. The main starting switch 59 can then also be closed which will thereby result in energization of motor 36 and rotation of the filter unit 33. This will also result in energization of the valves 17 and 24, which valves will be opened whereby contaminated liquid will flow from tank 11 through conduit 14 into the filter unit 33 and new cleaning liquid will flow from make-up tank 23 through conduit 22 into the discharge conduit 19.

The energization of motor 36 causes the filter unit 33 to be rotated at high speeds, such as in the order of 4,000 to 5,000 rpm. The contaminated liquid which is supplied via conduit 14 into the compartment 43 defined within the interior of the filter unit 33 is thus forced outwardly against the annular sidewall 41 due to the centrifugal force imposed on the fluid. The fluid is then forced radially outwardly through the discharge openings 46 and is forced through the filter pack 51. In being forced to flow through the filter pack 51, the solid particles entrained with the fluid and having a particle size in excess of 1 micron are trapped by the filter pack 51, and specifically the filter pad 52. The filtered liquid, on the other hand, freely passes through the filter pack 51 and is discharged into the compartment 27 defined within the cylindrical casing 26. The filtered cleaning fluid then flows downwardly through the discharge conduit 19 and mixes with the new cleaning liquid supplied by the conduit 22. The mixture of the new and used cleaning liquid is then supplied to the tank 21 where same is stored until further use of same is desired.

When passing through the filtered pack 51, some of the larger dirt particles become trapped by the inner-support screen 54 which is of extremely fine mesh. However, the extremely small particles are removed from the liquid by the thin filter pad 52. In this manner, essentially all of the dirt particles having a size in excess of 1 micron are removed from the cleaning liquid, whereby the thus filtered cleaning liquid is sufficiently clean and pure so as to permit its reuse in cleaning a floor. In this manner, the same cleaning liquid can be recycled through the filter system several times and thereby reused several times prior to disposal thereof.

With respect to the quantity of new cleaning liquid added to the system by the makeup tank 22, this quantity can obviously be varied as desired, such as by providing a suitable adjustable flow control orifice of the like in association with the conduit 22. Also, the flow control valve 24 can be suitably opened and closed in whatever sequence desired so as to control the flow through the conduit 22.

When the filter packs 51' become partially clogged with dirt particles, then the filter device 16 can be cleaned by first removing the cover 28 to provide access to the filter unit 33. Each individual cap 48 can then be unscrewed from its respective support hub 47, which cap will contain therein the filter pack 51. This pack 51 can be removed from the cap 48 and individually separated as illustrated in FIG. 5. The screens 53, 54, and 56 can then be cleaned as necessary, and a new filter pad 52 inserted between the screens 53 and 54. The pack 51 is the reassembled in the order illustrated in FIG. 5 and repositioned within the cap 48. The cap 48 is then threaded onto the hub 47 until the gasket 57 is suitably compressed, whereupon the filter pack 51 is then clampingly held between the opposed surfaces formed on the hub 47 and the respective cap 48. The filter unit 33, and the overall filter system 10 is then in condition for further operation.

MODIFICATION

Figure 7:
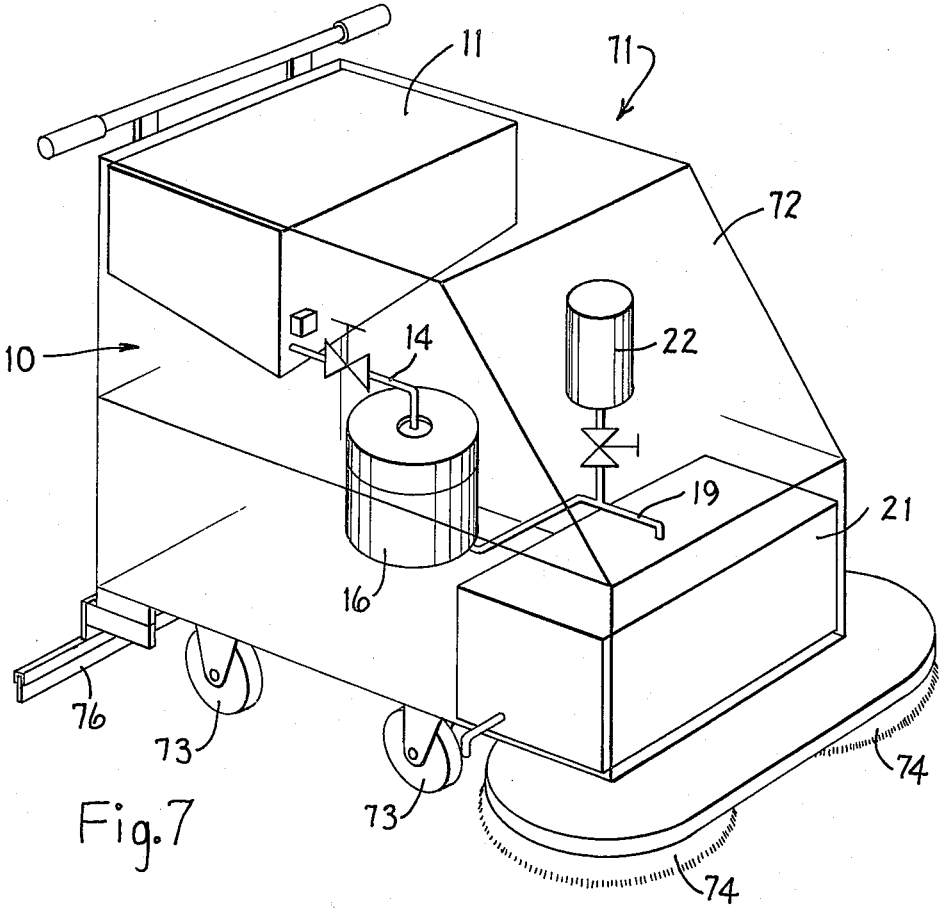
FIG. 7 diagrammatically illustrates a conventional floor cleaning machine, which machine has been modified to incorporate therein the filtering system illustrated in FIG. 1.
Figure 8:
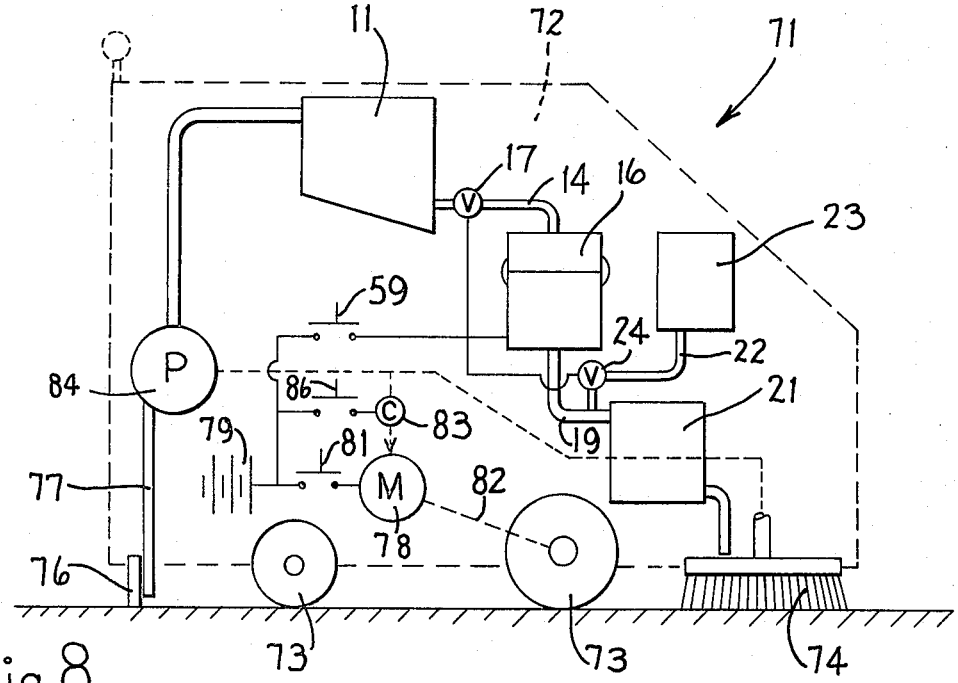
FIG. 8 is a diagrammatic illustration of the floor cleaning machine of FIG. 7.

FIGS. 7 and 8 illustrate therein a modification of the present invention wherein the filter system 10 is incorporated into a mobile floor cleaning machine 71, which machine 71 is otherwise of substantially conventional construction.

The machine 71 includes a housing 72 for encasing the various machine components, and is supported by front and rear pairs of rollers 73. In the illustrated embodiment, the front pair of rollers constitute drive wheels, whereas the rear pair of rollers constitute steering casters. Machine 71 also has a pair of counter-rotating floor scrubbing brushes 74 mounted adjacent the forward end thereof, which brushes are in a position for engagement with the floor to permit scrubbing thereof. The brushes 74 are supplied with a suitable cleaning liquid, for which purpose the machine is provided with a tank 21 for storing therein the cleaning liquid.

The floor cleaning machine 71 also has a wiper mechanism 76 associated with the rearward end thereof, which wiper mechanism collects the dirty liquid on the floor and, by virtue of the suction nozzle 77 (FIG. 8), sucks up this liquid and deposits same into a holding tank 11.

The cleaning machine 71 includes a main drive motor 78 which may be either of electrical or combustion type, same being illustrated as an electrical motor energized by batteries 79 in the illustrated embodiment. Motor 78 is controlled by a main control switch 81 which, when closed, results in energization of motor 78 so as to result in driving of the main drive rollers 73 by means of any conventional intermediate drive linkage as diagrammatically illustrated by dotted line 82. Drive motor 78 is also interconnected via an intermediate disengageable clutch 83 to both the brushes 74 and the vacuum pump 84 associated with the nozzle 77. The clutch 84 is in turn energized for movement into a closed position by means of a separate control switch 86.

The basic structure of the floor washing machine 71, as described above, is conventional and accordingly the above represents only a diagrammatic representation of this known structure. It will be appreciated, however, that such machines vary substantially as to the exact manner in which the brushes and other components of the machine are structurally arranged and driven, but these variations do not effect the manner in which the filter system of the present invention coacts with the overall floor cleaning machine.

Pursuant to the present invention, the two tanks which are normally associated with the machine, namely the tank for the contaminated liquid and the tank for the new liquid, are incorporated into the filter system 10 so that the tanks 11 and 21 are thus connected in communication with one another via the intermediate centrifugal filter device 16. Thus, the contaminated liquid which is collected from the floor and supplied to the tank 11 can be forwarded to the filter device 16, wherein the wax and other solid particles are filtered from the liquid. The thus filtered cleaning liquid is then resupplied to the tank 21 for further supply to the brushes 74. In this manner, the floor cleaning liquid can be recycled through the machine several times and reapplied to the floor several times to facilitate the cleaning thereof. The recycling of the dirty liquid from the tank 11 into the tank 21 is accomplished by depressing the switch 59 so that the centrifugal filter device 16 is energized, simultaneously with the opening of the flow control valves 17 and 24. The operation of the filter device when mounted on the floor washing machine is thus exactly the same as the operation described above.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a mobile floor-cleaning machine having brush means for cleaning a floor, first tank means for supplying cleaning liquid to the brush means, second tank means for collecting the contaminated liquid removed from the floor, and liquid removal means for removing the contaminated liquid from the floor and for supplying same to said second tank means, the improvement comprising:

centrifugal filter means mounted on said machine and connected in series between said first tank means and said second tank means for removing solid contaminants from the cleaning liquid as said cleaning liquid is transferred from said second tank means to said first tank means, said centrifugal filter unit comprising a rotatable casing having a plurality of openings in the sidewall thereof, a filter pack disposed in each of said openings for filtering the cleaning liquid that flows therethrough in response to rotation of said casing, said filter pack comprising a thin sheet-like filter element and perforate support members on opposite sides of said filter element for supporting same, said filter element having a pore size capable of retaining solid particles having a particle size of greater than about 1 micron and capable of passing liquid and solids of smaller particle size; and third tank means mounted on said machine for containing a quantity of new cleaning liquid, passage means providing communication between said first and third tank means, and valve means associated with said passage means for controlling the flow of new cleaning liquid from said third tank means to said first tank means.

2. In a mobile floor-cleaning machine having brush means for cleaning a floor, first tank means for supplying cleaning liquid to the brush means, second tank means for collecting the contaminated liquid removed from the floor, and liquid removal means for removing the contaminated liquid from the floor and for supplying same to said second tank means, the improvement comprising:

centrifugal filter means mounted on said machine and connected in series between said first tank means and said second tank means for removing solid contaminants from the cleaning liquid as said cleaning liquid is transferred from said second tank means to said first tank means, said centrifugal filter unit comprising a rotatable casing having a plurality of openings in the sidewall thereof, said casing having an outwardly projecting, externally threaded annular hub surrounding each of said openings, an internally threaded annular cap threaded onto each of said hubs, a filter pack covering each of the openings for filtering the cleaning liquid that flows therethrough in response to rotation of said casing, said filter pack comprising a thin sheet-like filter element and perforate support members on opposite sides of said filter element for supporting same, said filter element having a pore size capable of retaining solid particles having a particle size of greater than about 1 micron and capable of passing liquid and solids of smaller particle size, said filter pack being disposed between the outer end of its associated hub and the inner surface of its associated cap and being clamped therebetween and covering its associated opening.

3. The combination according to claim 2 including valve means between said second tank means and said centrifugal filter means for controlling the flow of contaminated floor-cleaning liquid from said second tank means to said centrifugal filter means.

4. The combination according to claim 2, wherein said centrifugal filter means comprises a stationary hollow casing mounted on said machine, a first passage communicating with said stationary hollow casing adjacent the lower end thereof and extending to said first tank means, said rotatable casing being disposed within said stationary casing and comprising a hollow cylindrical member having said openings in the annular sidewall thereof, a second passage extending from the second tank means and communicating with the interior of said cylindrical member.

5. The combination according to claim 2, wherein said filter element is a substantially circular disk of sheetlike material.

6. A filtering system for removing contaminating solid particles from a floor-cleaning liquid, comprising:

a centrifugal filter device for removing solid particles from said liquid, said filter device including a substantially stationary hollow casing defining an interior compartment therein and a filter unit disposed within said compartment and rotatable relative to said casing, said filter unit being mounted for rotation about a substantially vertical axis;

said filter unit comprising a hollow drumlike member having spaced upper and lower walls joined by a substantially annular sidewall, said annular sidewall having a plurality of radially directed, individual, discharge openings extending therethrough, said discharge openings being angularly spaced from one another circumferentially of said sidewall, said topwall having an inlet opening formed therein for permitting contaminated liquid to be supplied into the interior of said filter unit;

said filter unit including individual filter packs mounted on said drumlike member and covering each of said discharge openings, each of said filter packs including a thin and flexible sheetlike filter member which permits the free passage of said liquid therethrough but prevents the passage of solid particles having a size in excess of about one micron whereby to recover said liquid free from solid particles having a particle size of greater than about 1 micron and a condition suitable for reuse, each of said filter members being sandwiched between a pair of meshlike support screens positioned on opposite sides of said sheetlike filter member for supporting same;

a plurality of individual ringlike caps removably attached to said drumlike member in alignment with said discharge openings, said caps coacting with said drumlike member for clamping said filter packs therebetween in positions wherein said filter packs extend across said discharge openings;

first tank means for containing therein a contaminated liquid containing solid particles, said first tank means being in communication with the inlet opening associated with said filter unit for permitting said contaminated liquid to be supplied thereto; and second tank means for receiving the filtered liquid, said second tank means being in communication with the compartment defined by said casing.

7. A system according to claim 6, wherein said casing is substantially cylindrical and has removable cover means associated with the upper end thereof, said cover means having an opening formed centrally thereof and aligned with the inlet opening formed in the top wall of said drumlike member, and motor means fixedly connected to said casing and having a motor shaft projecting into the interior of said casing and having said filter unit nonrotatably secured thereto.

* * * * *